US006805237B2

(12) United States Patent
Curry

(10) Patent No.: US 6,805,237 B2
(45) Date of Patent: Oct. 19, 2004

(54) BLUEPRINT CADDY

(76) Inventor: Rory Dwayne Curry, 6445 Liberty-Fairfield, Hamilton, OH (US) 45011

( * ) Notice: Subject to any disclaimer, the term of this patent is extended or adjusted under 35 U.S.C. 154(b) by 146 days.

(21) Appl. No.: 10/259,693

(22) Filed: Sep. 30, 2002

(65) Prior Publication Data

US 2004/0060832 A1 Apr. 1, 2004

(51) Int. Cl.[7] ..... B65D 69/00

(52) U.S. Cl. ..... 206/224; 206/472; 402/73; 281/45; 462/81

(58) Field of Search ..... 206/224, 472; 402/73; 281/45, 15.1, 27.1; 462/81, 71, 78

(56) References Cited

U.S. PATENT DOCUMENTS 2,288,267 A * 6/1942 Cochran et al. ..... 101/131
RE23,906 E * 12/1954 Griffin ..... 462/81
3,775,870 A * 12/1973 Griggs et al. ..... 206/472
4,014,508 A * 3/1977 Weiss ..... 248/451
4,530,175 A * 7/1985 Wellman ..... 40/661
D364,640 S * 11/1995 Zimbelman ..... D19/27
6,626,601 B1 * 9/2003 Moor et al. ..... 402/73

* cited by examiner

*Primary Examiner*—Jila M. Mohandesi

(57) ABSTRACT

A portable carrier for containing, using, displaying, protecting and modifying blueprints in an outdoor working environment. The Blueprint Caddy ("Caddy") includes a removable and durable plastic or polyethylene cover, affixed by means of two detachable pin hinges, which allows for both the protection of any prospective blueprints and easy alterations or amendments to same by means of a wax pencil. The back of the Caddy is constructed with a storage area allowing for the safe and convenient storage of the cover when its use is not desired. The Caddy is equipped with two plastic lock down elongated clamps which fit into channeled grooves of the Caddy to support and restrain blueprints of either twenty-four or thirty-six inches in length with a wrap around storage slot to slide unwanted pages of any blueprints utilized. The top of the Caddy is constructed with two small contained storage areas for carrying wax pencils or other writing materials, erasers, cloths, etc. The Caddy is also equipped with a handle at the top and four one inch removable legs on the back to allow it to be laid flat or posted on a wall for use in the field. The handle likewise allows the Caddy to be carried in convenient fashion to respective job sites.

5 Claims, 4 Drawing Sheets

BLUEPRINT CADDY

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

A type of case for carrying blueprints or other large documents is presented, and particularly adapted to the difficult problem of transporting, displaying, protecting from the elements, altering or modifying large-sized blueprint drawings in outdoor or indoor working environments.

While there have been many briefcase and clipboard style devices conceived for special purposes, the difficult problem of containing and displaying, protecting and offering a means of easily altering or modifying blueprint drawings in a working environment has not been effectively addressed. Blueprints, which can be as large as 2 or 3 feet wide and 3 feet long, can be unwieldy documents, and the customary way of carrying them is to roll a package of drawings up into a tube-shape length secured by a strap or rubber bands. This makes handling the documents very difficult in the hostile outdoor or indoor environment, perhaps in windy conditions, as a flat surface must be found to roll out the documents. The blueprints must be restrained from their tendency to roll back up again either by being held down manually or by being weighted at the corners. These difficulties are compounded when the blueprints must be carried from one portion of the working site to another and used by various personnel on a construction project, especially in inclement weather conditions.

As the number of blueprints on a large construction project is also large, carrying the blueprints together in a large package prevents difficulties of keeping them organized as well as the difficulties of displaying in a flat fashion and protecting them from the environment. The bundles of documents tend to become separated and inconvenient to collect, collate and carry away at the end of a working day on a construction site. Further when modifications, alterations or amendments are called for on a particular job, making said changes to any respective blueprints tends to be a cumbersome task.

The within invention seeks to address these problems by providing a specifically blueprint documents from their tendency to curl or flutter in hostile weather conditions, protect the documents from inclement weather conditions, provide a means of conveniently transporting large numbers of documents in an organized fashion, and giving the user the ability to effectuate fast and temporary changes to any respective document or blueprint with ease and confidence. The construction of the device described herein has become possible with the development and commercialization of modem materials and manufacturing methods that would not have been possible in earlier times. Thus it is an objective of the within invention to provide a means of carrying large and small blueprint documents conveniently.

A further objective of the invention is to accommodate either small numbers or large thicknesses of documents in a carrier that will accommodate these variations.

Yet another objective of the within invention is to provide a carrier that can also serve as a display surface for maintaining the blueprints in a flat configuration on the work site.

A further objective of this invention is to securely retain the blueprint documents yet enable use of multiple documents without losing or removing other documents in the stack.

A further objective of the within invention is to provide a display surface that has sufficient rigidity to be posted on a vertical or horizontal surface for a convenient working display at a construction site.

A further objective of the within invention is to provide two additional storage containers to securely maintain wax pencils, other writing utensils, erasers, cloths, etc.

A final objective of the within invention is to provide a clear removable plastic or polyethylene cover for both the protection of any documents or blueprints and to allow the user to make any temporary modifications, alterations or amendments to the documents by means of a wax pencil written directly upon the cover. Said cover being removable and said unit providing an attached storage area for the cover on its back when the cover is not in use. These and other objectives are achieved by the specifically configured Blueprint Caddy described herein.

BRIEF SUMMARY OF THE INVENTION

The Blueprint Caddy is a large rigid plastic display box sized to completely contain and display a typically dimensioned twenty-four or thirty-six inch blueprint document in addition to any border surrounding the document. Two detachable pin hinges on the box hold in place a removable plastic cover rounded on its left side to allow individual pages of any document placed therein to be folded over and stored within the box itself. The clear plastic cover provides both protection from the elements as well as allowing the user to make any temporary modifications to the document by writing directly on the plastic cover with a wax pencil. The cover is removable and the box is constructed with a convenient storage area on its back to store the cover when not in use. Documents placed within the Caddy are held securely in place by means of two sturdy plastic lock down elongated clamps which fit into channeled grooves of the Caddy to support either twenty-four or thirty-six inch documents. Additionally, the Caddy is constructed with two small contained storage spaces for securely storing wax pencils, other writing utensils, erasers, cloths, etc. Further, the Caddy has both a handle and four one inch removable legs which allow for easy transport and viewing, either horizontally or vertically, of any prospective document.

BRIEF DESCRIPTION OF THE SEVERAL VIEWS OF THE DRAWING

In the accompanying drawings which form part of the instant specification and which are to be read in conjunction therewith and in which like reference numerals are used to indicate like parts in the various views.

DETAILED DESCRIPTION OF THE INVENTION

Figure 1:
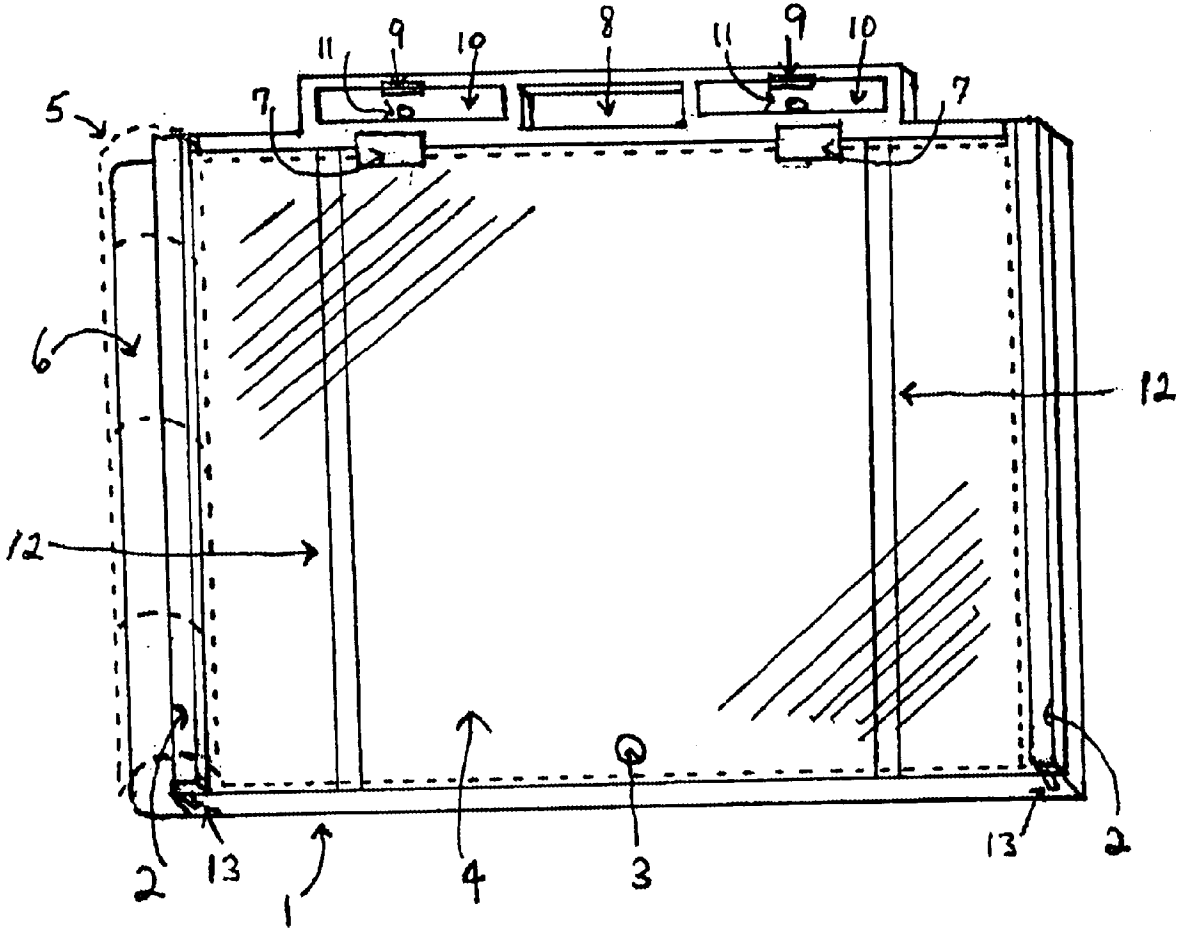
FIG. 1 is an overall top view embodiment of The Blueprint Caddy.

Referring now to FIG. 1, The Blueprint Caddy ("Caddy") is indicated generally by the reference to character 1. It is a rectangular box of substantially rigid plastic material which will be produced by means of either a vacuum or injection mold process. The dimensions of the Caddy will be approximately thirty-six inches in length, twenty eight inches in width and two and one-half inches in depth. The Caddy is designed to transport and safely retain standard blueprints of either twenty four or thirty six inches in length.

Attached to the Caddy, by means of two pin hinges 7 affixed to the top, will be a removable clear plastic or polyethylene cover, depicted generally by characters 4 and 5. The cover can be lifted by means of thumb-nail indentation 3. The cover is more fully described in FIGS. 3 and 4 below.

Molded within the Caddy 1 is a carrying handle 8 along with two small storage compartments 10 approximately eight inches in length, two inches in width and one inch in depth. The storage compartments will be affixed by means of hinges 9 and can be opened by thumb nail indentations 11 located on the front of each respective compartment. The storage compartments will allow for the easy storage of pencils, pens, erasers, the removable one inch legs (described in FIG. 6 below), etc.

Further molded within the Caddy 1 will be four channeled grooves 12 approximately one inch in width and one half inch in depth, running the width of the box to support two lock down elongated clamps 2 and 13 allowing for the retention of blueprints. Two of the channeled grooves will be located thirty-six inches apart and two will be located twenty four inches apart, respectively.

Lastly, character 6 depicts a molded running board of the Caddy 1 running the width of the Caddy 1 and protruding approximately two inches. This running board is designed to aid in the easy roll-over of unused or unwanted blueprint pages into a storage slot described in FIG. 5 below.

Figure 2:
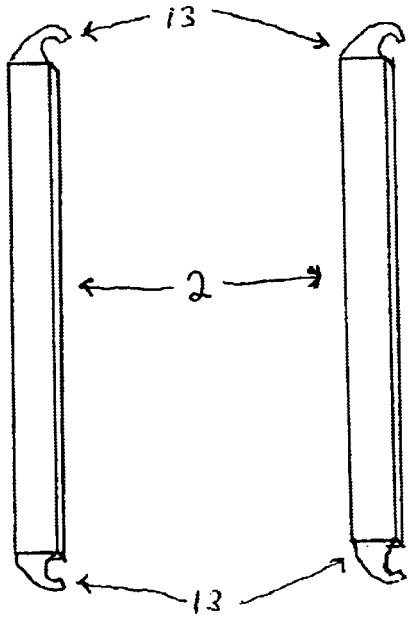
FIG. 2 is singled out view of the blueprint lock down bar mechanism depicted in FIG. 1.

FIG. 2 is a separate view of the two lock down elongated clamps 2 which are constructed out of the same rigid plastic material as the Caddy 1 and which are the same length as the Caddy's width. At the end of each of the respective clamps, is a molded beveled end 13, which is designed to lock over the end of the body of the Caddy 1 once the clamps are pressed over any blueprints and into the appropriate channels 12.

Figure 3:
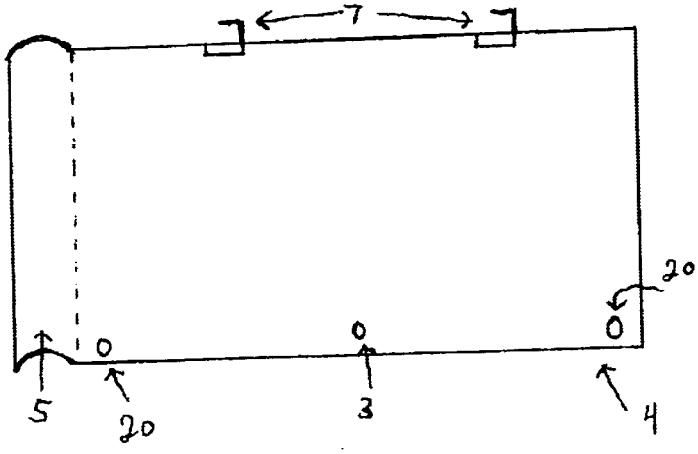
FIG. 3 is a singled out view of the clear plastic removable cover depicted by the broken lines in FIG. 1.
Figure 4:
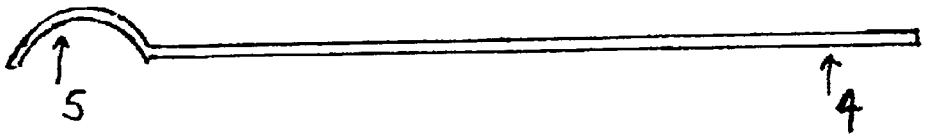
FIG. 4. is a side view of the clear plastic removable cover depicted in FIG. 3 and by the broken lines in FIG. 1.

FIGS. 3 and 4 are separate views of the removable clear plastic or polyethylene cover 4 from both its top and side views, respectively. The dimensions of the cover 4 are approximately one half inch shorter than the body of the Caddy 1 (as specified above), with the exception of the left side of the cover 4 which will be molded into a rounded shape 5 and will be approximately one-half inch in depth and extend over the left end of the Caddy over the running board 6.

The purpose of this design is to allow for the roll-over of blueprints into the storage slot 15 (FIG. 5) and to protect any blueprints from the elements. The cover 4 is detachable from the body of Caddy 1 by means of a sliding pin hinge 7 affixed to the cover 4 and the body of the Caddy 1. The cover 4 will be held in place, once on the body of the Caddy 1, by means of Velcro fasteners 20 affixed onto the corners of the cover 4. The cover 4 may be lifted from the body of the Caddy 1 by means of a thumb nail indentation 3 molded into the bottom center of the cover 4.

Figure 5:
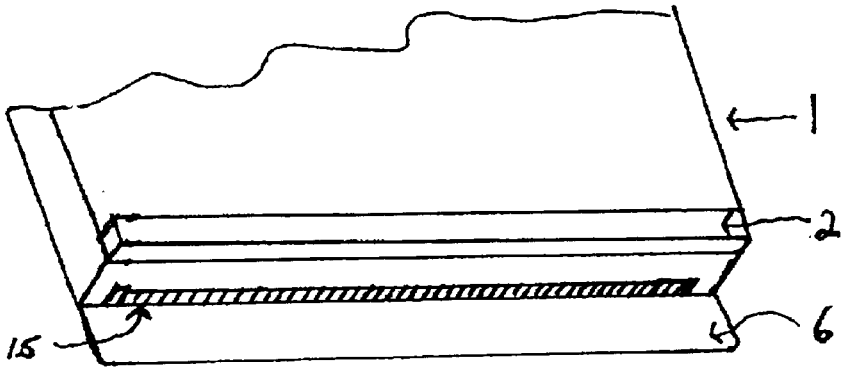
FIG. 5 is a side view of The Blueprint Caddy illustrating the roll-over storage capabilities of my invention for blueprint pages not being utilized.

FIG. 5 depicts a left side view of the Caddy 1. In the event that certain pages of any blueprints are not required, those pages may be wrapped around the left side of the Caddy 1, the end of the pages guided along the running board 6 and inserted into the body of Caddy 1 through a molded slot 15. The dimensions of slot 15 being approximately the width of Caddy 1 and one-half inch in height.

Figure 6:
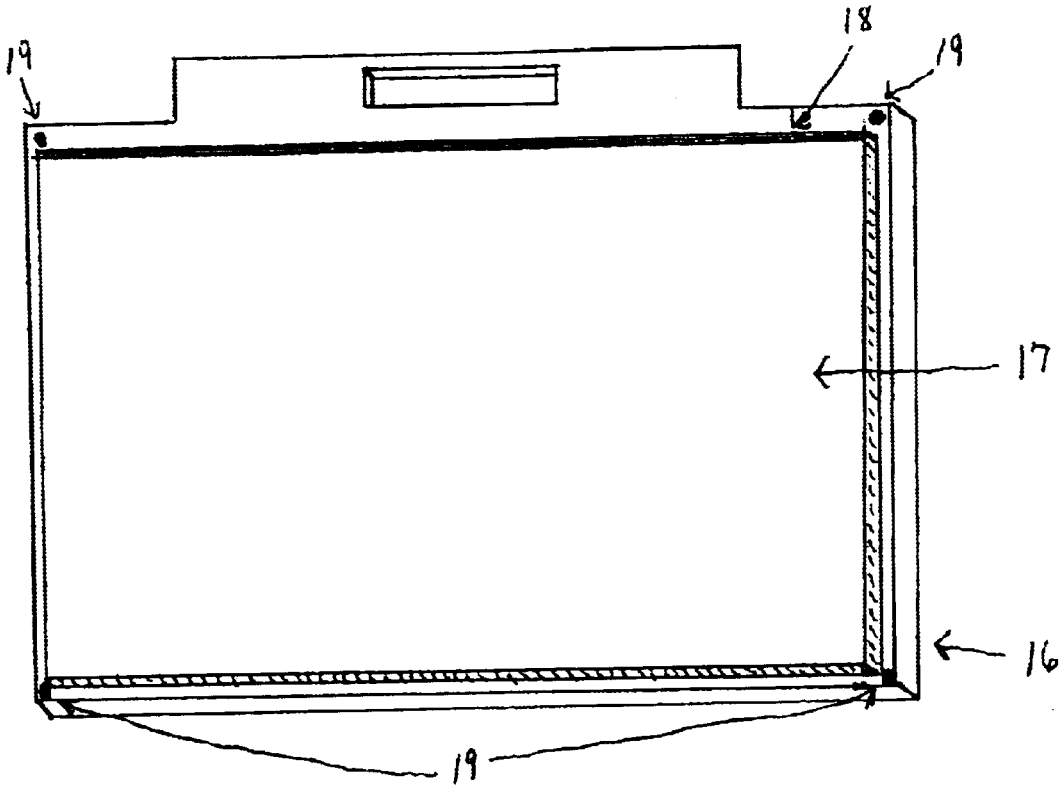
FIG. 6 is a rear view of The Blueprint Caddy illustrating the built in storage compartment which will be able contain the removable clear plastic cover when its use is not desired.

FIG. 6 depicts a reverse view of Caddy 1. Molded on the reverse side of Caddy 1, approximately the same dimensions as Caddy 1 (as described above in FIG. 1), is a storage container 17 which will house the removable clear plastic cover 4 and 5 when its use is not required or desired. Additionally, in each of the four corners of Caddy 1, there will be four removable one inch screw in legs 19, which will allow the Caddy 1 to be viewed horizontally without damaging the body of the Caddy 1. If vertical viewing is preferred, the legs may be removed and stored in storage containers 10.

It will be understood that certain features and sub-combinations are of utility and may be employed without reference to other features and sub-combinations. This is contemplated by and is within the scope of my claims. It is further obvious that various changes may be made in details within the scope of my claims without departing from the spirit of my invention. It is, therefore, to be understood that my invention is not to be limited to the specific details shown and described.

What I claim as my invention is:

1. A document carrier comprising:

a rectangular box of substantially rigid plastic material;

said box shaped and dimensioned to be approximately thirty-six inches in length, twenty-eight inches in width and two and one-half inches in depth to allow for the transportation, retention and protection of blueprints and similar documents;

said box incorporating a molded storage slot on the left side running the width of the box, approximately one-half inch in height, allowing unwanted document pages to be wrapped around the box and inserted into the slot for convenience and protection;

said box incorporating four channeled grooves, approximately one inch in width and one half inch in depth, running the width of the box to support two plastic lock down elongated clamps allowing for the retention of documents either twenty-four or thirty-six inches in length;

said box incorporating a handle at the top for carrying and/or placing the box in an upright mounted position when in use;

said box incorporating two small contained storage areas, with covers, approximately eight inches in length, two inches in width and one inch in depth;

said box incorporating two detachable pin hinges, fastening to the face of the box, a removable plastic or polyethylene cover;

said box incorporating, on its back, a molded slotted storage area for the convenient storage of the removable clear plastic cover when not in use; and said box incorporating, on its back, four one inch removable legs to allow viewing of documents in a horizontal position.

2. The device of claim 1 wherein said four channeled grooves support two plastic lock down elongated clamps allowing for the retention of documents either twenty-four or thirty-six inches in length, said clamps being approximately the same dimensions of the channels with beveled plastic ends allowing the clamps to be locked into place over the outer edges of the box.

3. The device of claim 1 wherein said two small contained storage areas, with covers, approximately eight inches in length, two inches in width and one inch in depth allow for the convenient storage of the removable one inch legs, wax pencils, other writing utensils, erasers, cloths, etc.

4. The device of claim 1 wherein said two detachable pin hinges, fastening to the face of the box, a removable plastic or polyethylene cover, said cover being the same approximate dimensions of the box, further fastened to the box by means of two Velcro fasteners located at each of the bottom corners and having on its left side, a rounded one inch end allowing for the roll over, protection and storage of individual pages of any prospective document utilized, with said box containing a storage area constructed on its reverse side to store the cover when not in use.

5. The device of claim 4 wherein the plastic or polyethylene cover provides both protection for any prospective document utilized and further allows for the amendment, alteration or modification of any such document by means of an erasable wax pencil written directly upon the cover.

* * * * *